US009404702B2

(12) United States Patent
Berg

(10) Patent No.: US 9,404,702 B2
(45) Date of Patent: Aug. 2, 2016

(54) ELECTROMECHANICAL FIRING MECHANISM

(71) Applicant: Leif Berg, Danderyd (SE)

(72) Inventor: Leif Berg, Danderyd (SE)

( * ) Notice: Subject to any disclaimer, the term of this patent is extended or adjusted under 35 U.S.C. 154(b) by 0 days.

(21) Appl. No.: 14/926,603

(22) Filed: Oct. 29, 2015

(65) Prior Publication Data

US 2016/0131450 A1 May 12, 2016

Related U.S. Application Data

(60) Provisional application No. 62/074,332, filed on Nov. 3, 2014.

(51) Int. Cl.
*F41A 19/00* (2006.01)
*F41A 19/59* (2006.01)
*F41A 3/12* (2006.01)

(52) U.S. Cl.
CPC .. *F41A 19/59* (2013.01); *F41A 3/12* (2013.01)

(58) Field of Classification Search
CPC ..... F41A 19/62
See application file for complete search history.

(56) References Cited

U.S. PATENT DOCUMENTS 3,198,074 A * 8/1965 Perkins ..... F41A 19/58 42/84
3,208,181 A * 9/1965 Calhoun ..... F41A 19/58 42/84
3,650,174 A * 3/1972 Nelsen ..... F41A 19/58 42/42.01
3,859,746 A * 1/1975 Pecksen ..... F41A 19/62 102/210
4,275,521 A * 6/1981 Gerstenberger ..... F41A 19/58 42/84
5,083,392 A * 1/1992 Bookstaber ..... F41A 17/06 42/84
5,713,150 A * 2/1998 Ealovega ..... F41A 19/59 42/84
2004/0020094 A1* 2/2004 Ealovega ..... F41A 19/46 42/69.03

FOREIGN PATENT DOCUMENTS

DE 202013005117 U1 * 7/2013 ..... F41A 19/59

* cited by examiner

*Primary Examiner* — Gabriel Klein
(74) *Attorney, Agent, or Firm* — McHale & Slavin, P.A.

(57) ABSTRACT

An electromechanical firing mechanism having a stack of piezoelectric elements arranged to move a firing pin by switching the piezoelectric material from a static state to an electrically charged state. The electromechanical firing mechanism is comprised of a bolt housing a striker and a firing pin. The bolt further includes a base plate and a center axis whereby the firing pin is moveable along that axis. The striker has a distal end and a proximal end, the distal end is fixed to a base plate and the proximal end is coupled to the firing pin. The striker consists of a stack of piezoelectric elements. A control circuit and battery is electrically connected to the piezoelectric materials for switching and powering the piezoelectric material from a static state to an electrically charged state. The stack of piezoelectric elements moves the firing pin into the primer of the cartridge when electrically charged.

7 Claims, 2 Drawing Sheets

ELECTROMECHANICAL FIRING MECHANISM

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 62/074,332, entitled "FIRING MECHANISM", filed Nov. 3, 2014. The contents of which the above referenced application is incorporated herein by reference.

FIELD OF THE INVENTION

The present invention generally relates to firearms, and particularly to a firearm with an electromechanical firing mechanism employing a layered stack of one or more piezoelectric elements, which upon application of an electric voltage pulse, generates sufficient force to displace a firing pin.

BACKGROUND OF THE INVENTION

Conventional firearm mechanisms are mechanical, relying on a combination of a lever, spring, and sear to transform pressure applied to the trigger lever to a release of the firing pin. The firing pin used in firearms usually has a small, rounded portion designed to strike the primer of a cartridge, detonating the priming compound, which then ignites the propellant (inside) or fires the detonator and booster. Firearms use triggers to initiate the firing of a cartridge in the firing chamber of a weapon. This is typically accomplished by actuating a striking device through a combination of spring and kinetic energy causing the firing pin to strike and ignite the primer of the cartridge. Firing is the sequence of events which ignites the propellant charge in the cartridge. The cartridge primer contains a small amount of percussion-sensitive explosive. When a striker hits the primer with sufficient mechanical pressure it detonates the primer material. This sends hot burning particles of primer material into contact with the propellant, initiating its burning. In single-shot and semiautomatic operation, each activation of the trigger results in only one shot being fired. In a fully-automatic operation, the entire operating cycle repeats itself as long as the trigger is pulled and ammunition is fed.

There are many ways to organize the mechanical firing chain. Probably the most common striker is a slender steel rod called a firing pin. In most cases, the firing pin is struck at the rear by a rotary hammer. Energized by the hammer, the firing pin then strikes the primer. In other designs, the firing pin is propelled directly by its own spring, or the hammer impacts the primer directly without an intervening firing pin. In modern revolvers the hammer usually hits a transfer bar which is moved into position only when the trigger is pulled. With the transfer bar in proper position, the striker can hit the transfer bar which then hits the primer. When the transfer bar is out of position, the gun should not discharge inadvertently if the gun is dropped.

There are two primary types of striking mechanisms: mechanical based hammers and strikers. Hammers are basically spring-tensioned masses of metal that pivot on a firing pin when released and strike the firing pin to discharge a cartridge. Strikers are essentially spring-loaded firing pins that travel on an axis in-line with the cartridge eliminating the need for a separate hammer, as discussed above. The hammer of a firearm is a part propelled to impart a blow (impact) that will initiate the weapon firing when the trigger is pulled. Its name comes from its resemblance and functional similarity to the common hand tool of the same name. The proximal result of the hammer's blow depends on the mechanism of the lock or action of which it forms a part.

Some weapons have been designed to fire electrically primed ammunition. Most of these require batteries carried in the gun, while some others have been designed with very complicated electromagnetic devices to generate the charge necessary to fire ammunition. A simple, reliable electromechanical firing mechanism containing a foolproof and fail-proof source of voltage would be accepted by most shooters and would make electric guns and ammunition popular. Such a firing mechanism could be more reliable than the current guns using mechanical strikers due to the greatly reduced number of parts, shortening of firing times, enabling electronic fire control using existing ammunition, and the reduction of the risk of slam fire.

SUMMARY OF THE INVENTION

An electromechanical firing mechanism having a stack of piezoelectric elements arranged to move a firing pin by switching the piezoelectric material from a static state to an electrically charged state is disclosed. The electromechanical firing mechanism is comprised of a bolt housing a striker and a firing pin. The bolt includes a base plate and a center axis whereby the firing pin is moveable along that center axis. The striker has a distal end and a proximal end, the distal end is fixed to a base plate and the proximal end consists of a stack of piezoelectric elements attached thereto. A control circuit is attached to the piezoelectric stack for switching the piezoelectric material from a static state to an electrically charged state. Further included is a battery for powering the electrically charged state of the piezoelectric material. The piezoelectric elements should move the firing pin when electrically charged.

Accordingly it is an objective of the instant invention to provide an electromechanical firing mechanism that shortens firing times, enables electronic fire control using existing ammunition, and reduces the risk of slam fire.

It is an objective of the instant invention to provide an electromechanical firing mechanism that reduces the risk of slam fire. Slam fire is a premature, usually unintended discharge of a firearm that occurs as a cartridge is being loaded into the chamber. The electromechanical firing mechanism will not discharge unless the piezoelectric material is switched from a static state to an electrically charged state thereby expanding the piezoelectric elements which causes the firing pin to move towards the cartridge.

Still another objective of the instant invention is to provide an electromechanical firing mechanism that shortens firing time. Using an electric charge in the piezoelectric material to move the firing pin greatly shortens the lock time, that is the delay between pulling, thus applying pressure to, the trigger and ignition of the round. The shortened lock times can also increase shooting precision.

Another objective of the instant invention is to provide an electromechanical firing mechanism that requires less electric power than prior art magnetic firing devices.

It is still another objective of the instant invention to provide an electromechanical firing mechanism that contemplates the use of piezoelectric material, such as lead zirconate titanate (PZT). However, other materials, or combinations thereof may prove more suitable for the present application.

Yet another objective of the instant invention is to provide an electromechanical firing mechanism that uses a stack of one or more piezoelectric elements configured to displace the firing pin about 0.5 mm, a sufficient penetration depth for safely firing a cartridge in existing firearms, when the piezoelectric material are switched from a static state to an electrically charged state. Thus electromechanical firing mechanisms can be used in most firearms with existing types of ammunition.

Yet another objective of the instant invention is to provide an electromechanical firing mechanism that includes a plurality of piezoelectric elements arranged in series as a multilayered stack whose elements are electrically coupled in parallel. In this arrangement, the voltage required to displace the firing pin the required distance is reduced compared to what occurs when using just one piezoelectric element.

It is an objective of the instant invention to provide an electromechanical firing mechanism that, upon actuation of the firearm trigger, an electrical pulse is sent to switch the piezoelectric materials from a static state to an electrically charged state, thereby displacing the firing pin to strike the cartridge.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
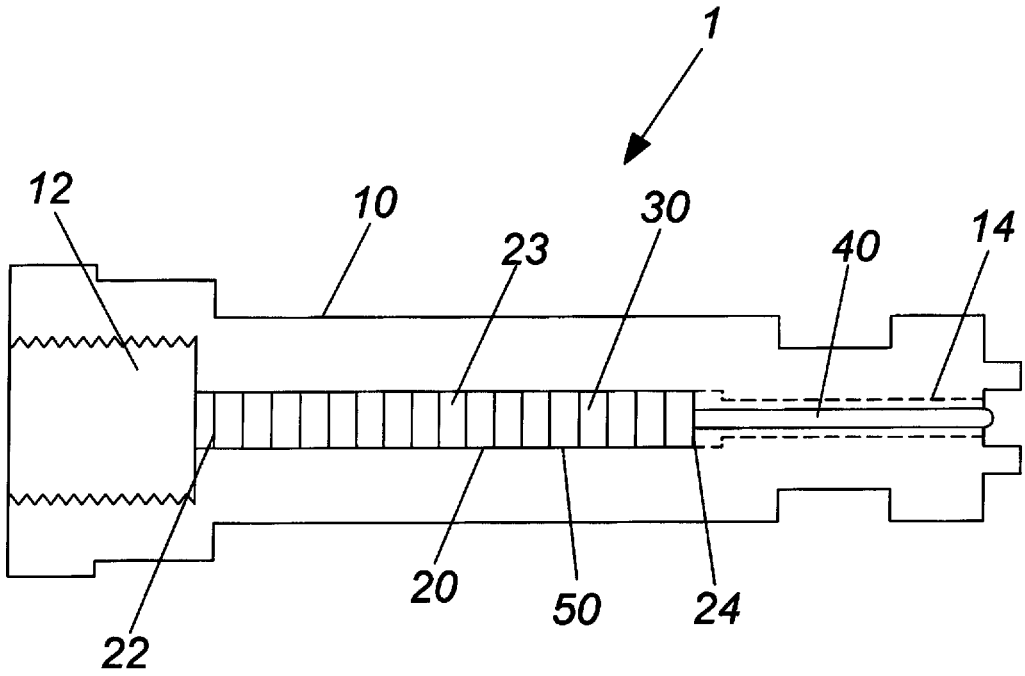
FIG. 1 is a top cross-sectional view of the bolt assembly of the instant invention having a stack of piezoelectric elements attached thereto.
Figure 2:
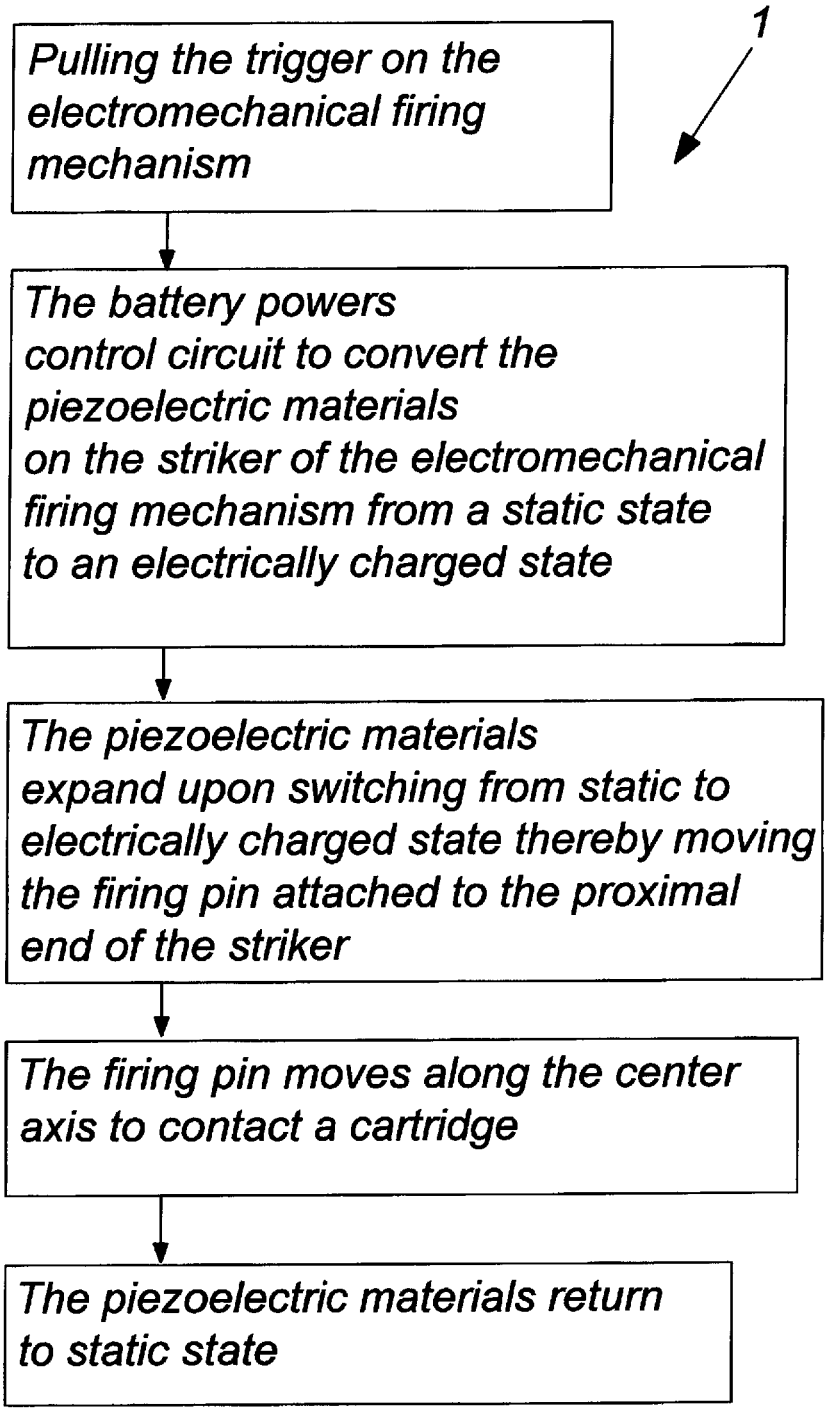
FIG. 2 is a diagram of the process of firing the instant invention

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring now to the Figures, set forth is an electromechanical firing mechanism 1 having a stack of piezoelectric elements 30 arranged to move a firing pin 40 as a result of switching the piezoelectric material 30 from a static state to an electrically charged state. The electromechanical firing mechanism 1 is comprised of a bolt 10 housing a base plate 12, a striker 20, and a firing pin 40. The bolt 10 is the mechanical part of a firearm that blocks the rear of the chamber while propellant ignites, but moves out of the way to allow another cartridge or shell to be inserted into the chamber, not shown. When the bolt 10 moves back, the extractor pulls the spent casing from the chamber; when the bolt 10 moves forward, it strips a cartridge from the magazine and pushes it into the chamber. Once the case is clear of the chamber, the ejector propels the case out of the weapon.

In the preferred embodiment, the bolt 10 includes a base plate 12 and a center axis 14 whereby the firing pin 40 is moveable along that center axis 14. The firing pin used in firearms usually has a small, rounded portion designed to strike the primer of a cartridge, detonating the priming compound, which then ignites the propellant (inside) or fires the detonator and booster. In a traditional firearm, a firing pin is a lightweight part, which serves to transfer energy from a spring-loaded striker to the primer, not shown. In the present invention, the striker is piezoelectrically driven.

The striker 20 has a distal end 22, a proximal end 24, and thereinbetween 23. The distal end 22 is fixed to the base plate 12 on the bolt 10. The proximal end and thereinbetween 23 consists mostly of a stack of piezoelectric elements 30. The distal end 22 of the striker is fixedly attached to the base plate 12 of the bolt using a fastening means such as, but not limited to, threaded connection or pinning, as shown in FIG. 1. The proximal end 24 of the striker displaces the firing pin 40 which will impact on the cartridge to initiate a firing when the trigger is pulled and the piezoelectric material is charged.

A control circuit 50 is attached to the piezoelectric material 30 for switching the piezoelectric material 30 from a static state to an electrically charged state. It is contemplated that the control circuit 50 may be fed directly by a control voltage or may be fed indirectly by induction through an induction coil. The piezoelectric material 30 displaces the firing pin 40 about .5 mm when electrically charged. Further included is a battery, not shown, for powering the electrically charged state of the piezoelectric material 30. The instant invention contemplates the use of piezoelectric materials 30, such as lead zirconate titanate (PZT).

The striker 20 is arranged to move inside the bolt 10, such that the firing pin 40 can move along the center axis 14 of the bolt 10. A typical firing distance for a firing pin 40 is about 0.5 mm. The piezoelectric materials 30 in at least one embodiment of the instant invention is configured to expand about 0.5 mm in the direction of the firing pin 40, when the piezoelectric material 30 is switched from a static state to an electrically charged state. The use of a piezoelectric material allows for a piezoelectric effect which is a reversible process in that materials exhibiting the direct piezoelectric effect (the internal generation of electrical charge resulting from an applied mechanical force) also exhibit the reverse piezoelectric effect (the internal generation of a mechanical strain resulting from an applied electrical field). Thus after the electric pulse, the piezoelectric material 30 will immediately return to its original position. Slam fire is a premature, usually unintended discharge of a firearm that occurs as a cartridge is being loaded into the chamber. The electromechanical firing mechanism 1 will not discharge unless the piezoelectric material 30 is switched from a static state to an electrically charge state thereby expanding the piezoelectric material 30 and moving the firing pin 40 towards the cartridge. It is contemplated, that a stack of piezoelectric elements 30 may be positioned along the striker 20.

The trigger, not shown, is the user interface to the firing assembly. Typically, a firearm has a trigger, handle, and bolt 10 arranged in the back of the barrel. In a preferred embodiment, the trigger is electronically connected to the control circuit 50 and the battery. When the trigger is pulled, the control circuit 50 receives a desired voltage pulse to switch the piezoelectric material 30 from its static state to its electrically charged state. A low-voltage material may operate at between 100-200V, and a high-voltage material around 1 kV.

The method of firing a cartridge is based upon the steps of pulling the trigger on the electromechanical firing mechanism 1, the battery powers the control circuit 50 to convert the stack of piezoelectric elements 30 on the striker 20 of the electromechanical firing mechanism 1 from a static state to an electrically charged state, the piezoelectric materials 30 expand upon switching from a static to an electrically charged state thereby displacing the firing pin 40 attached to the proximal end 24 of the striker 20, the firing pin 40 moves along the center axis 14 to contact a cartridge, and the stack of piezoelectric material 30 returns to a static state. In an alternative embodiment, the firing pin is not fixedly attached to the striker, but allowed some free movement to increase the striking distance beyond the limits set by the piezoelectric expansion. In this embodiment, the striker will impart sufficient kinetic energy to the firing pin to penetrate the primer to a sufficient depth to initiate firing.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An electromechanical firing mechanism comprising:

a bolt having a base plate, said bolt housing a striker having a distal end secured to said base plate, a proximal end, and thereinbetween;

a firing pin coupled to said proximal end of said striker, said firing pin moveable along a center axis of said bolt to mechanically initiate firing of a cartridge;

said striker consisting of at least one piezoelectric element, said at least one piezo electric element being arranged in a stack to move said firing pin;

a control circuit attached to said at least one piezo electric element for switching said at least one piezoelectric element from a static state to an electrically charged state; and a battery for powering said control circuit;

wherein said control circuit is used to charge said at least one piezoelectric element causing an expansion towards said firing pin, when said at least one piezoelectric element is switched from said static state to said electrically charged state, to move said firing pin into contact with a primer of the cartridge to initiate firing.

2. The electromechanical firing mechanism of claim 1, wherein a trigger is electronically connected to said control circuit and said battery.

3. The electromechanical firing mechanism of claim 2, wherein actuation of said trigger sends a voltage pulse to said control circuit for switching said at least one piezoelectric element from a static state to an electrically charged state.

4. The electromechanical firing mechanism of claim 1, wherein said at least one piezoelectric element moves the firing pin about 0.5 mm.

5. The electromechanical firing mechanism of claim 3, wherein said control circuit is fed directly by a control voltage.

6. The electromechanical firing mechanism of claim 3, wherein said control circuit is fed indirectly by induction through an induction coil.

7. The electromechanical firing mechanism of claim 3, wherein said at least one piezoelectric element is lead zirconate titanate (PZT).

* * * * *